United States Patent [19]

Pouille

[11] 3,960,478

[45] *June 1, 1976

[54] SYNTHETIC CHINCHILLA FUR PRODUCTION BY REVERSE SIDE APPLICATION OF DYE SOLUTION

[76] Inventor: Georges Pouille, 2, Rue de Linselles, 59 Halluin, France

[ * ] Notice: The portion of the term of this patent subsequent to Oct. 28, 1992, has been disclaimed.

[22] Filed: May 15, 1975

[21] Appl. No.: 577,670

Related U.S. Application Data

[62] Division of Ser. No. 319,240, Dec. 29, 1972, Pat. No. 3,915,629.

[52] U.S. Cl. ..... 8/14; 8/148; 8/149; 8/1 XB

[51] Int. Cl.[2] ..... D06P 50/00

[58] Field of Search ..... 8/14, 148, 149

[56] References Cited

UNITED STATES PATENTS

| | | | |
|---|---|---|---|
| 2,071,922 | 2/1937 | Drobile | 8/1 XB |
| 2,815,558 | 12/1957 | Bartovics et al. | 8/1 XB |
| 3,010,179 | 11/1961 | Thal | 8/1 XB |

*Primary Examiner*—Donald Levy
*Attorney, Agent, or Firm*—Ernest G. Montague; Karl F. Ross; Herbert Dubno

[57] ABSTRACT

In a process for dyeing a plush fabric having a long pile the dye is applied to the back of the fabric. The process is suitable for the production of imitation fur, in particular imitations of lynx and chinchilla furs.

1 Claim, No Drawings

SYNTHETIC CHINCHILLA FUR PRODUCTION BY REVERSE SIDE APPLICATION OF DYE SOLUTION

This is a division of U.S. Pat. application Ser. No. 319,240, filed Dec. 29, 1972, now U.S. Pat. No. 3,915,629.

The present invention relates to a plush fabric having a long pile, in particular imitation fur. The invention is more particularly concerned with a process of dyeing such fabric by printing.

Various dyeing processes by printing exist but they are not entirely satisfactory for the production of fur imitations.

In particular a process is known which utilises a wooden printing plate and which is related to blanket or pad printing. Furthermore the frame process, the Lyonnese process, and the aerography process are well known; flat frames or cylindrical frames are used therein. There exists also a process using a cylindrical copper roller which is deeply engraved; the printing ink or dye is deposited thereon by a roller and excess ink or dye is removed by a doctor blade; the ink or dye accumulates in the depressions and is transferred to the tissue or fabric. Furthermore a process is known wherein dye is projected by jets which are appropriately disposed at the desired locations. Finally, processes are known by which involve the use of paper-based transfers with which are similar to decalcomanias.

Each of these processes has its advantages and disadvantages, but none is entirely satisfactory for localised dyeing of long-pile plush fabrics because the dye cannot be accurately applied to the pile.

The production of imitation furs has been hindered heretofore by the fact that the pile could not be dyed differently along the length thereof to obtain "hairs", the ground portion of which was of different colour from the rest. This problem applies in particular to imitations of lynx and chinchilla which could not be satisfactorily produced heretofore. Admittedly a certain length of the free ends of the pile or hairs could be dyed by known methods, but not the ground portions.

The present invention has as an object to avoid this disadvantage and to provide a process which permits the desired object to be attained.

The process of the invention is characterised mainly in that the plush fabric is dyed from the back thereof in such manner that the dye penetrates and reacts with the plush fabric in a more or less limited manner starting from the root of the pile.

This dyeing process may be effected over the whole surface of the plush fabric, but preferably it is applied to locally limited areas which may be as small as spots. The spots or areas thus obtained may have different colours and the dye may be applied successively to the same areas or spots, or to locations which overlap each other; alternatively different locations may be printed with different dyes.

Sufficiently high pressure must be used for causing the dye to penetrate the tissue or fabric, the pressure being of the order of several tens of bars.

In one example of the invention a plush fabric with long pile tufts is used. Dye is supplied to the backing of the fabric by means of a frame which is pressed hard against the back of the fabric in order that the dye is transferred across the whole thickness of the backing in such manner that it is distributed over the portion of the pile tufts adjacent the backing.

Several successive prints of this kind may be effected with different dyes. Such successive prints may be superimposed one on the other, or they may be arranged to overlap each other; alternatively they may be carried into effect at entirely different locations.

Owing to the use of frames the printed spots or areas can be disposed and arranged in any desired manner, and by effecting the prints with appropriately selected dyes, correct imitations of lynx or chinchilla can be produced.

While I have disclosed several embodiments of the present invention, it is to be understood that these embodiments are given by example only and not in a limiting sense.

I claim:

1. In a process for the production of synthetic fur imitation of chinchilla fur, wherein a long pile is provided upon a surface of a fabric backing, the improvement which comprises dyeing the pile by forcing a dye over only limited areas of the fabric backing through the latter at a pressure of the order of several tens of bars from the side of the fabric backing opposite that from which the pile extends and sufficient to effect diffusion of the dye along the pile over only a limited length thereof.

* * * * *